US007030328B1

(12) United States Patent
Beerling

(10) Patent No.: US 7,030,328 B1
(45) Date of Patent: Apr. 18, 2006

(54) LIQUID METAL SWITCH EMPLOYING MICRO-ELECTROMECHANICAL SYSTEM (MEMS) STRUCTURES FOR ACTUATION

(75) Inventor: Timothy Beerling, San Francisco, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 11/021,382

(22) Filed: Dec. 22, 2004

(51) Int. Cl.
*H01H 29/00* (2006.01)

(52) U.S. Cl. ..... 200/182; 200/193

(58) Field of Classification Search ..... 200/182–194, 200/214, 229, 233
See application file for complete search history.

(56) References Cited

U.S. PATENT DOCUMENTS 4,264,798 A 4/1981 Graf
5,808,593 A * 9/1998 Sheridon ..... 345/84
6,356,401 B1 * 3/2002 Bates et al. ..... 360/51
6,545,815 B1 * 4/2003 Kroupenkine et al. ..... 359/665
6,559,420 B1 5/2003 Zarev
6,665,127 B1 * 12/2003 Bao et al. ..... 359/665
6,778,328 B1 * 8/2004 Aizenberg et al. ..... 359/665
6,829,415 B1 * 12/2004 Kroupenkine et al. ..... 385/37
6,847,493 B1 * 1/2005 Davis et al. ..... 359/665
6,936,196 B1 * 8/2005 Chandross et al. ..... 264/1.36
6,946,776 B1 * 9/2005 Fong et al. ..... 310/328

* cited by examiner

*Primary Examiner*—Elvin G. Evad
*Assistant Examiner*—Lisa Klaus

(57) ABSTRACT

An electronic switch comprises a droplet of conductive liquid located in contact with a surface having an alterable surface configuration, an input contact located on the alterable surface and configured such that the input contact is in constant electrical contact with the droplet, and a microelectronic mechanical system (MEMS) for altering the surface configuration to change the contact angle of the droplet with respect to the surface.

17 Claims, 4 Drawing Sheets

LIQUID METAL SWITCH EMPLOYING MICRO-ELECTROMECHANICAL SYSTEM (MEMS) STRUCTURES FOR ACTUATION

BACKGROUND OF THE INVENTION

Many different technologies have been developed for fabricating switches and relays for low frequency and high frequency switching applications. Many of these technologies rely on solid, mechanical contacts that are alternatively actuated from one position to another to make and break electrical contact. Unfortunately, mechanical switches that rely on solid—solid contact are prone to wear and are subject to a condition referred to as "fretting." Fretting refers to erosion that occurs at the points of contact on surfaces. Fretting of the contacts is likely to occur under load and in the presence of repeated relative surface motion. Fretting manifests as pits or grooves on the contact surfaces and results in the formation of debris that may lead to shorting of the switch or relay.

To minimize mechanical damage imparted to switch and relay contacts, switches and relays have been fabricated using liquid metals to wet the movable mechanical structures to prevent solid to solid contact. A typical switch uses mercury or gallium alloys to wet the contacts to reduce problems associated with solid—solid metal contact. Unfortunately, it has been difficult to design, fabricate and commercialize a switch having sub-millimeter size and employing liquid metal in some capacity to prevent fretting and that can carry sufficient current.

SUMMARY OF THE INVENTION

In accordance with the invention an electronic switch comprises a droplet of a conductive liquid located in contact with a surface having an alterable surface configuration. The surface configuration is altered using a micro-electronic mechanical system (MEMS) to change the contact angle of the droplet with respect to the surface. Changing the contact angle of the droplet with respect to the surface leads to translational movement of the droplet.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The embodiments in accordance with the invention described below can be used in any application where it is desirable to provide fast, reliable switching. While described below as switching a radio frequency (RF) signal, the architectures can be used for other switching applications.

Figure 1A:
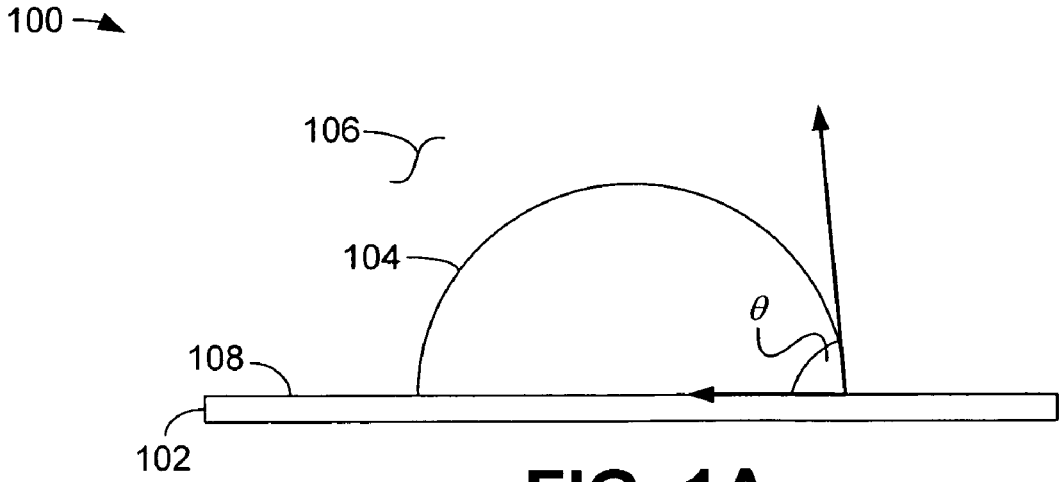
FIG. 1A is a schematic diagram illustrating a system including a droplet of conductive liquid residing on a solid surface.

FIG. 1A is a schematic diagram illustrating a system 100 including a droplet of conductive liquid residing on a solid surface in accordance with the invention. The droplet 104 can be, for example, mercury or a gallium alloy, and resides on a surface 108 of a solid 102. A contact angle, also referred to as a wetting angle, is formed where the droplet 104 meets the surface 108. The contact angle is indicated as θ and is measured at the point at which the surface 108, liquid 104 and gas 106 meet. The gas 106 can be, in this example, air, or another gas that forms the atmosphere surrounding the droplet 104. A high contact angle, as shown in FIG. 1A, is formed when the droplet 104 contacts a surface 108 that is referred to as relatively non-wetting, or less wettable. The wettability is generally a function of the material of the surface 108 and the material from which the droplet is formed, and is specifically related to the surface tension of the liquid.

Figure 1B:
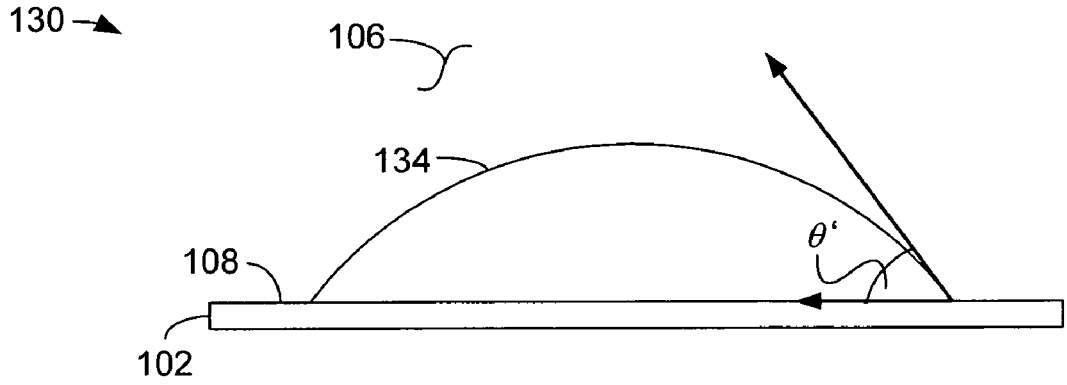
FIG. 1B is a schematic diagram illustrating the system of FIG. 1A having a different contact angle.

FIG. 1B is a schematic diagram 130 illustrating the system 100 of FIG. 1A having a different contact angle. In FIG. 1B, the droplet 134 is more wettable with respect to the surface 108 than the droplet 104 with respect to the surface 108, and therefore forms a lower contact angle, referred to as θ'. As shown in FIG. 1B, the droplet 134 is flatter and has a lower profile than the droplet 104 of FIG. 1A.

The concept of altering the surface on which the droplet rests to change the contact angle relies on the ability to alter the wettability of the surface to alter the contact angle that a conductive liquid forms with respect to a surface with which the conductive liquid is in contact. In general, the contact angle between a conductive liquid and a surface with which it is in contact ranges between 0° and 180°.

Figure 2A:
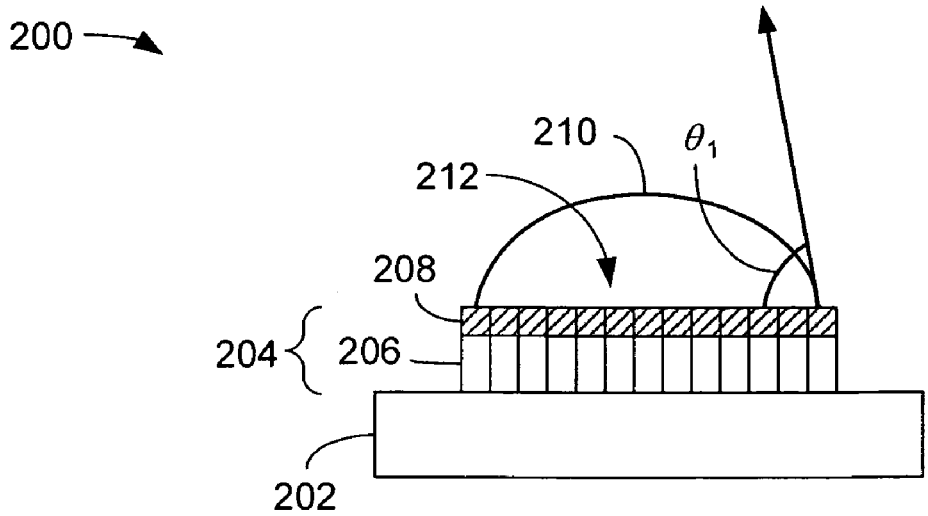
FIG. 2A is a schematic diagram illustrating one manner in which a moveable micro-electronic system (MEMS) structure can alter the contact angle between a droplet of conductive liquid and a surface that it contacts.

FIG. 2A is a schematic diagram 200 illustrating one manner in accordance with the invention in which a moveable micro-electronic system (MEMS) structure can alter the contact angle between a droplet of conductive liquid and a surface that it contacts. In FIG. 2A, a droplet 210 of conductive liquid rests on a surface 212 formed by a MEMS structure 204. The MEMS structure 204 is formed over a substrate 202. The substrate 202 can be, for example, silicon, PYREX® or another suitable mechanical substrate. The MEMS structure 204 comprises a plurality of moveable, or deformable, beams 206 having contact portions 208 located over the beams 206. The material of the contact portions 208 forms the surface 212 on which the droplet rests. In this embodiment in accordance with the invention, the droplet 210 is referred to as a "sessile" droplet. A sessile droplet is one that contacts only a surface, such as surface 212. Further, while shown in FIG. 2A as being in contact, some or all of the beams 206 and associated contact portions 208 are free standing and independently moveable as will be described below.

While the droplet 210 is located over the surface 212, it should be understood that the term "over" is meant to describe a spatially invariant relative relationship between the droplet 210 and the surface 212. Moreover, the droplet 210 is located proximate on the surface 212 so that if the droplet 210 were inverted, the droplet 210 would still be proximate to the surface 212 as shown. Further, the relationship between the droplet and the surfaces in the embodiments to follow is similarly spatially invariant.

The beams 206 can be fabricated using, for example, silicon dioxide, silicon nitride, polysilicon, or another suitable thin film material. The contact portion 208 can be fabricated using a material to which the droplet 210 can wet, but that will not adversely react with the material from which the droplet 210 is formed. The droplet 210 forms a contact angle with respect to the surface 212. The contact angle is determined by the material of the surface 212 and the amount of contact area between the droplet 210 and the surface 212. Under a static condition, the droplet 210 forms a contact angle, referred to as $\theta_1$, with respect to the surface 212.

In one embodiment in accordance with the invention, portions of the MEMS structure 204 are moveable. For example, the beams 206 are moveable with respect to the substrate 202. As will be described below, in one embodiment, selected beams 206 and contact portions 208 are lowered to alter the amount of the surface 212 in contact with the droplet 210. Moving the beams 206 and the contact material 208 will cause the liquid metal to dewet with respect to the contact material 208 on the beams 206 that were moved. The dewetting of the droplet 210 will reduce the amount of the droplet 210 in contact with the contact portion 208. This increases the contact angle between the surface 212 and the droplet 210.

Figure 2B:
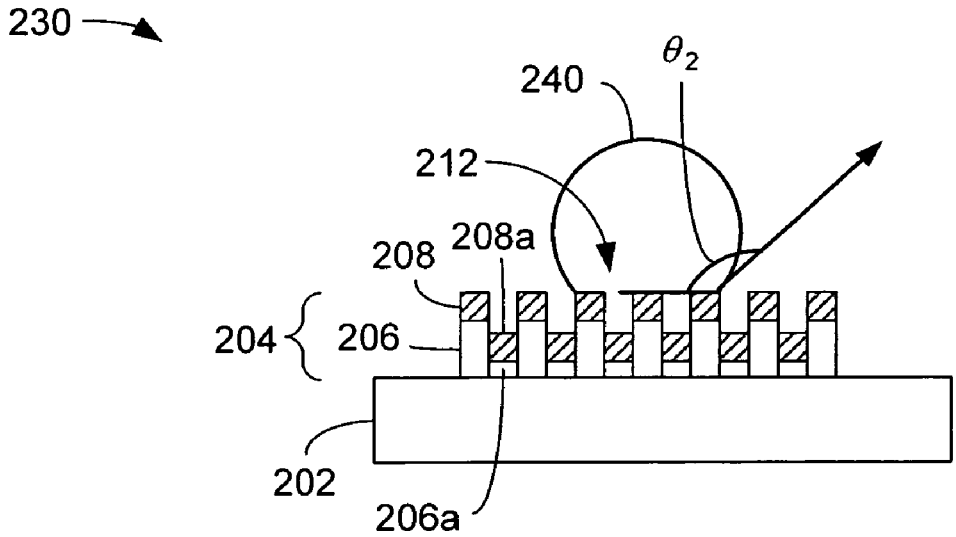
FIG. 2B is a schematic diagram illustrating the system of FIG. 2A in which selected ones of the beams and contact portions are lowered to change the amount of surface in contact with the droplet.

FIG. 2B is a schematic diagram 230 illustrating the system 200 of FIG. 2A in which selected ones of the beams 206 and contact portions 208 are lowered to change the amount of surface 212 in contact with the droplet 240. As an example, every other beam 206*a* and contact portion 208*a* is moved downward toward the substrate 202. Alternatively, other combinations of the beams 206 and associated contact portions 208 may be moved or deformed to change the surface 212 that is in contact with the droplet 210. Moving the beam 206*a* and contact portion 208*a* is known to those having ordinary skill in the art of moveable MEMS structures. As an alternative to moving the beam 206*a* and contact portion 208*a*, the beam 206*a* may be deformed or twisted to alter the surface 212 that contacts the droplet 240. So long as the liquid metal of the droplet 210 dewets from the surface 212, the desired increase in contact angle will occur. As shown in FIG. 2B, altering the surface 212 changes the contact angle formed where the droplet 240 contacts the surface 212, forming a new contact angle $\theta_2$. The new contact angle, $\theta_2$, places the droplet 240 in what is referred to as a "less-wetting" or "dewetted" state than the droplet 210 of FIG. 2A. As will be described below, the change in the contact angle alters the curvature of the droplet and leads to translational movement of the droplet.

Figure 3A:
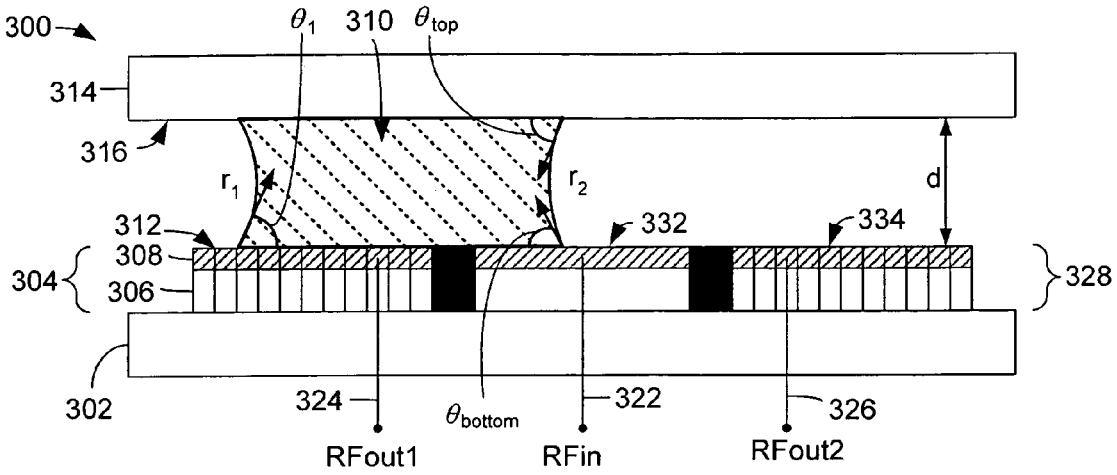
FIG. 3A is a schematic diagram illustrating an electrical switch employing a conductive liquid droplet.

FIG. 3A is a schematic diagram illustrating an electrical switch 300 employing a conductive liquid droplet in accordance with the invention. The switch 300 includes a substrate 302 having a surface 312 forming the floor of the switch, and a roof member 314 having a surface 316 that forms the roof of the switch 300. A droplet 310 of a conductive liquid is sandwiched between the surface 312 and the surface 316.

The substrate 302 includes a MEMS structure 304 having beams 306. the beams 306 are moveable as described above. Each beam 306 includes a contact portion 308 that contacts the droplet 310. The surface 312 is formed by the contact portions 308.

In this example, the switch 300 includes electrical contacts 322, 324, and 326 positioned to contact the surface 312 approximately as shown. In this example, the contact 322 is a radio frequency (RF) input, and the contacts 324 and 326 are RF outputs. However, the function of the switch 300 is not limited to switching RF signals. The input contact is in electrical contact with a portion 332 of contact material that is non-moveable. As shown in FIG. 3A, the droplet 310 is in electrical contact with the input contact 322 and the output contact 324. Further, in this example, the droplet 310 will always be in contact with the input contact 322.

When shown as a cross section, the droplet 310 includes a first radius, $r_1$, and a second radius, $r_2$. When the droplet 310 is at rest, the radius $r_1$ equals the radius $r_2$. The radius, r, of the droplet is defined as $$r = \frac{d}{\cos\theta_{top} + \cos\theta_{bottom}} \qquad \text{Eq. 1}$$

where d is the distance between the surface 312 and the surface 316, $\cos\theta_{top}$ is the contact angle between the droplet 310 and the surface 316 and $\cos\theta_{bottom}$ is the contact angle between the droplet 310 and the surface 312. Therefore, as shown in FIG. 3A, the droplet 310 is at rest whereby the radius $r_1$ equals the radius $r_2$, but the radii are in opposing directions.

Upon lowering selected beams 306 and associated contact portions 308, a new contact angle between the droplet 310 and the surface 312 is defined. In this example, while only the surface 312 is altered and the contact angle, $\theta_{bottom}$, between the droplet 310 and the surface 312 changes, the radius of curvature $r_1$ changes. To change the contact angle of the droplet 310 with respect to the surface 312 the surface 312 is altered by, in this embodiment in accordance with the invention, moving or lowering the beams 306 and associated contact portions 308. Changing the contact angle between the droplet 310 and the surface 312 alters the curvature of one the surfaces of the droplet 310. If the curvatures of the two surfaces of the droplet 310, shown as $r_1$ and $r_2$, are not the same (the curvatures are in opposing directions at rest with no pressure differential), then the pressure on each surface will be different, thus inducing translational movement of the droplet 310. The following equation describes the pressure difference on each side of the droplet 310.

$$P = \gamma\left(\frac{1}{r_1} + \frac{1}{r_2}\right) \qquad \text{Eq. 2}$$

The term P is the pressure on the droplet and the term $\gamma$ is the surface tension of the liquid. Equation 2 assumes the curvature of the droplet 310 is dominated by the distance, d, from the surface 312 to the surface 316, and not by the sidewalls of the fluid chamber (not shown).

Figure 3B:
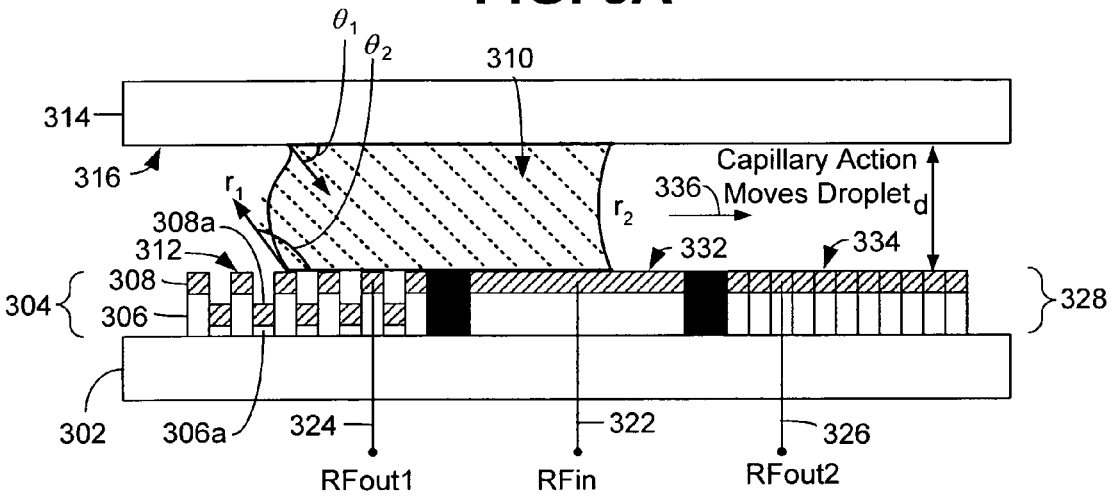
FIG. 3B is a schematic diagram illustrating the movement imparted to a droplet of conductive liquid as a result of the change in contact angle due to altering the surface on which the droplet resides.

FIG. 3B is a schematic diagram illustrating the movement imparted to a droplet of conductive liquid as a result of the change in contact angle due to altering the surface 312. When the movement of the beams 306 alters the surface 312, the contact angle of the droplet 310 with respect to the surface 312 in FIG. 3A changes so that the radius of curvature of one surface of the droplet 310 changes, leading to a pressure difference between the two droplet surfaces. A new contact angle, $\theta_2$, is formed as a result of the change in the surface 312 in the vicinity of the contact 324, thus changing the radius of curvature, $r_1$, of the surface of the droplet 310. When the curvatures of the two surfaces of the droplet 310 differ, a pressure differential is induced across the droplet, thus causing the droplet to translate across the surface 312 in the direction indicated by arrow 336.

Figure 3C:
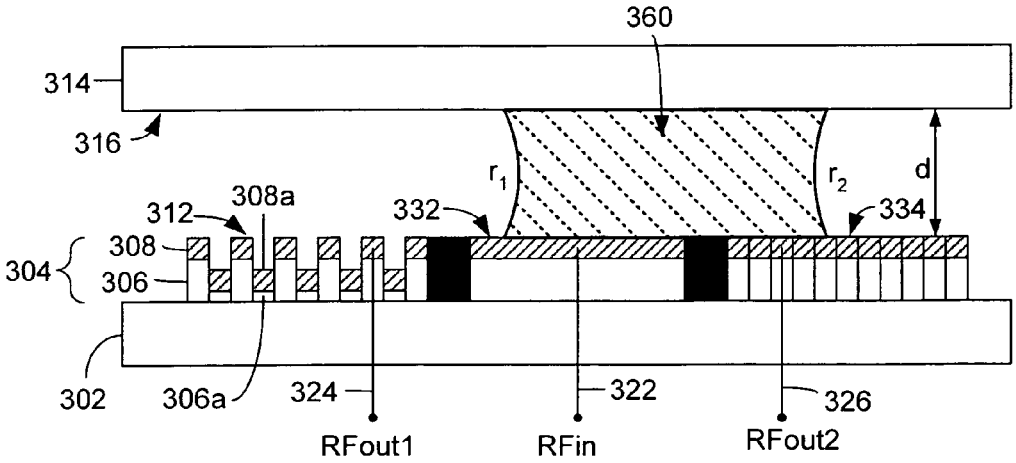

FIG. 3C is a schematic diagram 350 illustrating the switch 300 of FIG. 3A after the change in contact angle has caused the droplet to translate across the surface 312. As shown in FIG. 3C, the droplet 360 has moved so that the droplet 360 now electrically connects the input contact 322 and the output contact 326. In this manner, contact angle change induced by altering the surface 312 can be used to induce translational movement in a conductive liquid. The surface 334 may be configured similar to the surface 312 so that the droplet 360 may be translated back to its original state as shown ion FIG. 3A.

The energy required to induce the movement of the droplet 310 is the energy required for dewetting the droplet 310 from the surface 312, plus the strain energy in the beams 306 when in the deformed state. A number of different actuation methodologies may be used to move the beams 306. For example, electrical, electrostatic, thermal, ferromagnetic, lorentz and piezoelectric methodologies may be used to move and/or to deform the beams 306 to alter the surface 312.

Figure 4:
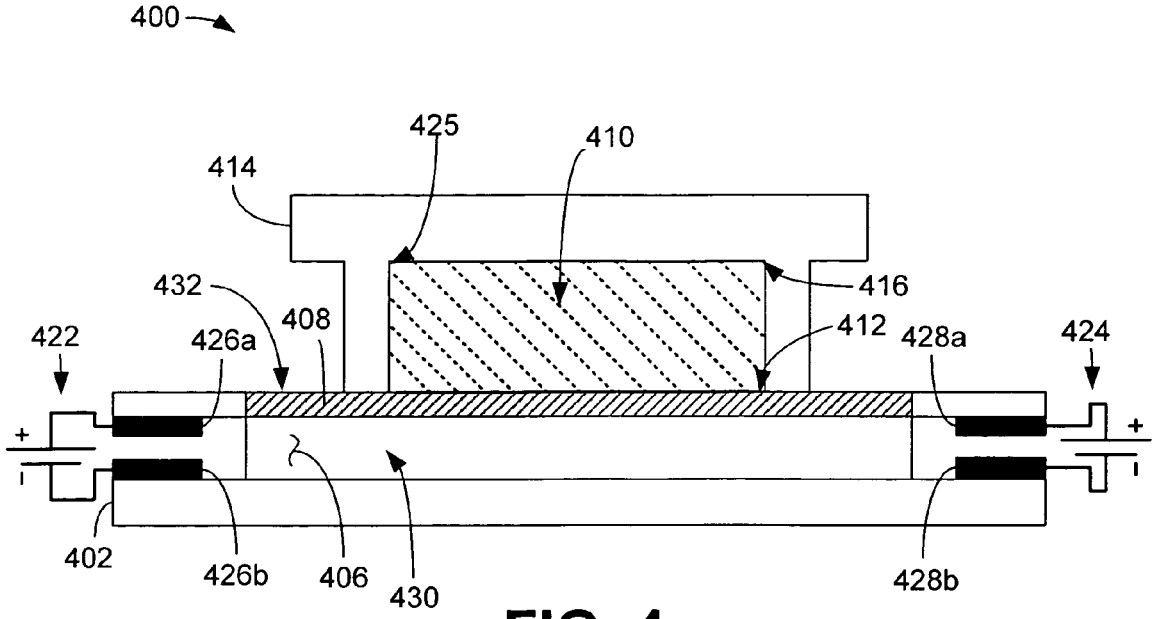
FIG. 4 is a schematic diagram illustrating a cross-section of an embodiment of an electronic switch.

FIG. 4 is a schematic diagram illustrating a cross-section of an embodiment of an electronic switch 400. In the switch 400, a droplet 410 of a conductive liquid rests on a surface 412 of a contact material 408. The contact portion 408 is located over a beam 406. A roof portion 414 forms surfaces 416 and 425 that together with the surface 412 encapsulate the droplet 410 in a micro-fluidic chamber. The electrical contacts are omitted from the switch 400 shown in FIG. 4 for simplicity of illustration.

The switch 400 includes a power source 422 coupled to electrodes 426*a* and 426*b*, and a power source 424 coupled to electrodes 428*a* and 428*b*. In this embodiment, the power sources 422 and 424 are depicted as electrical (voltage) sources, but can be other power sources that may cause the beam 406 to move or deform. The power sources 422 and 424 can be referred to as the transduction electronics because they cause the beam 406 to deform or move, thus imparting motion to the droplet 410 as described above. In the embodiment in accordance with the invention shown in FIG. 4, and when implemented to switch RF signals, to ensure that the RF signals does not couple to the transduction electronics that cause the beam to deform, there is a region 430 of the beam 406 and contact portion 408 that is electrically isolated from the power sources 422 and 424 and related electrodes 426*a*, 426*b*, 428*a* and 428*b*. The droplet 410 contacts the beam 406 and the contact portion 408 in the region 430 to minimize the possibility of electrical coupling between the RF signal and the transduction electronics that control the deformation and movement of the beam 406. The surface 412 may also be covered with a dielectric film 432 in the vicinity of the droplet 410 to prevent an electrical path from forming between the RF signal path and the transduction electronics.

This disclosure describes illustrative embodiments in accordance with the invention in detail. However, it is to be understood that the invention defined by the appended claims is not limited by the embodiments described.

We claim:

1. An electronic switch, comprising:

a droplet of conductive liquid located in contact with a surface having an alterable surface configuration;

an input contact located on the alterable surface and configured such that the input contact is in constant electrical contact with the droplet; and a deformable micro-electronic mechanical system (MEMS) for altering the surface configuration to change the contact angle of the droplet with respect to the surface.

2. The electronic switch of claim 1, in which the deformable MEMS structure further comprises moveable beams that alter the surface configuration.

3. The electronic switch of claim 1, wherein altering the surface configuration to change the contact angle of the droplet imparts a pressure change across the droplet.

4. The electronic switch of claim 3, wherein the pressure change across the droplet imparts translational motion to the droplet.

5. The electronic switch of claim 4, further comprising a roof structure over the droplet, the roof structure configured to form a micro-fluidic chamber to contain the droplet.

6. The electronic switch of claim 5, in which the switch is a two position switch and the droplet latches.

7. A method for making an electronic switch, comprising:

providing a substrate;

providing a surface having an alterable surface configuration comprising at least one deformable micro-electronic mechanical system (MEMS) structure;

providing a droplet of conductive liquid in contact with the surface;

providing an input contact on the surface and configured such that the input contact is in constant electrical contact with the droplet; and altering the surface configuration to change the contact angle of the droplet with respect to the surface.

8. The method of claim 7, in which the deformable MEMS structure further comprises moveable beams that alter the surface configuration.

9. The method of claim 7, wherein altering the surface configuration to change the contact angle of the droplet imparts a pressure change across the droplet.

10. The method of claim 9, wherein the pressure change across the droplet imparts translational motion to the droplet.

11. The method of claim 10, further comprising providing a roof structure over the droplet, the roof structure configured to form a micro-fluidic chamber to contain the droplet.

12. The method of claim 11, in which the switch is a two position switch and the droplet latches.

13. An electronic switch, comprising:

a droplet of conductive liquid located in contact with a surface having an alterable surface configuration comprising moveable beams;

an input contact located on the alterable surface and configured such that the input contact is in constant electrical contact with the droplet; and means for altering the surface configuration to change the contact angle of the droplet with respect to the surface.

14. The electronic switch of claim 13, in which the means for altering the surface configuration further comprises a micro-electronic mechanical system (MEMS) structure.

15. The electronic switch of claim 14, in which the means for altering the surface configuration is chosen from electrical, electrostatic, thermal, ferromagnetic, lorentz and piezoelectric methodologies.

16. The method of claim 13, wherein altering the surface configuration to change the contact angle of the droplet imparts a pressure change across the droplet.

17. The method of claim 16, wherein the pressure change across the droplet imparts translational motion to the droplet.

* * * * *